US005457903A

United States Patent [19]

Lopez

[11] Patent Number: 5,457,903

[45] Date of Patent: Oct. 17, 1995

[54] PERPETUAL MECHANICAL CALENDAR

[76] Inventor: Gerardo A. Lopez, 38 Rockledge Ave., White Plains, N.Y. 10601

[21] Appl. No.: 615,247

[22] Filed: Nov. 19, 1990

[51] Int. Cl.[6] ..... G09D 3/10

[52] U.S. Cl. ..... 40/109; 40/488; 49/128; 74/89.12

[58] Field of Search ..... 40/107, 109, 489, 40/490, 491, 508, 509, 510, 513, 488; 283/2; 49/128, 130; 74/89.12, 89.17; 273/284, 287; 434/199, 405; D19/20, 25

[56] References Cited

U.S. PATENT DOCUMENTS

| | | | |
|---|---|---|---|
| 1,401,385 | 12/1921 | Windahl | 40/109 |
| 1,668,280 | 5/1928 | Maschmann | 40/109 |
| 1,869,066 | 7/1932 | Vonder Lippe Lipski | 40/488 |
| 3,986,405 | 10/1976 | Hatch | 74/89.12 X |
| 3,995,862 | 12/1976 | Bertin | 273/284 X |
| 4,251,935 | 2/1981 | Wright | 283/2 X |
| 4,669,219 | 6/1987 | Tomida | 49/130 |

*Primary Examiner*—Peter R. Brown
*Assistant Examiner*—J. Bonifanti

[57] ABSTRACT

A perpetual mechanical calendar is disclosed which includes a front board having twelve windows, a sliding plate mounted behind the front board and being printed with two series of numbers, portions of which are visible through the windows of the front board, a rack and gear assembly for horizontal adjustment of the sliding plate relative to the front board, and lever assemblies for vertical positioning of the sliding plate relative to the front board. The sliding plate can be horizontally moved between seven different positions corresponding to years which begin on each day of the week. Additionally, the sliding plate can be raised and lowered to display a series of numbers which corresponds to the proper calendar for standard years in one setting and leap years in the other.

7 Claims, 6 Drawing Sheets

| | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| 1 | 0001 | 0029 | 0057 | 0085 | 0113 | 0141 | 0169 | 0197 | 0225 | 0253 | 0281 | 0309 | 0337 | 0365 | 07 | 757 | 1785 | | 1825 | 1853 | 1881 | | 1921 | 1949 | 1977 | 2005 | 2033 | 2061 | 2089 | 2101 | 1 |
| 2 | 02 | 30 | 58 | 86 | 14 | 42 | 170 | 98 | 26 | 54 | 82 | 310 | 38 | 66 | | 58 | 86 | | 26 | 54 | 82 | | 22 | 1950 | 78 | 06 | 34 | 62 | 2090 | 02 | 2 |
| 3 | 03 | 31 | 59 | 87 | 15 | 43 | 71 | 99 | 27 | 55 | 83 | 11 | 39 | 67 | | 59 | 87 | | 27 | 55 | 83 | | 23 | 51 | 79 | 07 | 35 | 63 | 91 | 03 | 3 |
| 10 | 04 | 32 | 60 | 88 | 16 | 44 | 72 | 200 | 28 | 56 | 84 | 12 | 340 | 68 | 2 | 1760 | 88 | | 28 | 56 | 84 | | 24 | 52 | 1980 | 08 | 36 | 64 | 92 | 04 | 10 |
| 6 | 05 | 33 | 61 | 89 | 17 | 45 | 73 | 01 | 29 | 57 | 85 | 13 | 41 | 6 | 53 | 61 | 89 | 01 | 29 | 57 | 85 | | 25 | 53 | 81 | 09 | 37 | 65 | 93 | 05 | 6 |
| 7 | 06 | 34 | 62 | 90 | 18 | 46 | 74 | 02 | 230 | 58 | 86 | 14 | 42 | 3 | 34 | 62 | 1790 | 02 | 1830 | 58 | 86 | | 26 | 54 | 82 | 2010 | 38 | 66 | 94 | 06 | 7 |
| 1 | 07 | 35 | 63 | 91 | 19 | 47 | 75 | 03 | 31 | 59 | 87 | 15 | 43 | | 35 | 63 | 91 | 03 | 31 | 59 | 87 | | 27 | 55 | 83 | 11 | 39 | 67 | 95 | 07 | 1 |
| 8 | 08 | 36 | 64 | 92 | 120 | 48 | 76 | 04 | 32 | 260 | 88 | 16 | 44 | | 36 | 64 | 92 | 04 | 32 | 1860 | 88 | | 28 | 56 | 84 | 12 | 2040 | 68 | 96 | 08 | 8 |
| 4 | 09 | 37 | 65 | 93 | 21 | 49 | 77 | 05 | 33 | 61 | 89 | 17 | 45 | 9 | 37 | 65 | 93 | 05 | 33 | 61 | 89 | 01 | 29 | 57 | 85 | 13 | 41 | 69 | 97 | 09 | 4 |
| 5 | 10 | 38 | 66 | 94 | 22 | 150 | 78 | 06 | 34 | 62 | 290 | 18 | 46 | 9 | 38 | 66 | 94 | 06 | 34 | 62 | 1890 | 02 | 1930 | 58 | 86 | 14 | 42 | 2070 | 98 | 2110 | 5 |
| 6 | 11 | 39 | 67 | 95 | 23 | 51 | 79 | 07 | 35 | 63 | 91 | 19 | 47 | | 39 | 67 | 95 | 07 | 35 | 63 | 91 | 03 | 31 | 59 | 87 | 15 | 43 | 71 | 99 | 11 | 6 |
| 13 | 12 | 40 | 68 | 96 | 24 | 52 | 180 | 08 | 36 | 64 | 92 | 320 | 48 | | 740 | 68 | 96 | 08 | 36 | 64 | 92 | 04 | 32 | 1960 | 88 | 16 | 44 | 72 | | 12 | 13 |
| 2 | 13 | 41 | 69 | 97 | 25 | 53 | 81 | 09 | 37 | 65 | 93 | 21 | 49 | 7 | 41 | 69 | 97 | 09 | 37 | 65 | 93 | 05 | 33 | 61 | 89 | 17 | 45 | 73 | | 13 | 2 |
| 3 | 14 | 42 | 70 | 98 | 26 | 54 | 82 | 210 | 38 | 66 | 94 | 22 | 350 | 78 | 2 | 1770 | 98 | 1810 | 38 | 66 | 94 | 06 | 34 | 62 | 1990 | 18 | 46 | 74 | | 14 | 3 |
| 4 | 15 | 43 | 71 | 99 | 27 | 55 | 83 | 11 | 39 | 67 | 95 | 23 | 51 | 79 | | 71 | 99 | 11 | 39 | 67 | 95 | 07 | 35 | 63 | 91 | 19 | 47 | 75 | | 15 | 4 |
| 11 | 16 | 44 | 72 | 100 | 28 | 56 | 84 | 12 | 240 | 68 | 96 | 24 | 52 | 380 | | 72 | | 12 | 1840 | 68 | 96 | 08 | 36 | 64 | 92 | 2020 | 48 | 76 | | 16 | 11 |
| 7 | 17 | 45 | 73 | 01 | 29 | 57 | 85 | 13 | 41 | 69 | 97 | 25 | 53 | 81 | 0 | 73 | | 13 | 41 | 69 | 97 | 09 | 37 | 65 | 93 | 21 | 49 | 77 | 2100 | 17 | 7 |
| 1 | 18 | 46 | 74 | 02 | 130 | 58 | 86 | 14 | 42 | 270 | 98 | 26 | 54 | 82 | 4 | 74 | | 14 | 42 | 1870 | 98 | 1910 | 38 | 66 | 94 | 22 | 2050 | 78 | | 18 | 1 |
| 2 | 19 | 47 | 75 | 03 | 31 | 59 | 87 | 15 | 43 | 71 | 99 | 27 | 55 | 83 | | 75 | | 15 | 43 | 71 | 99 | 11 | 39 | 67 | 95 | 23 | 51 | 79 | | 19 | 2 |
| 9 | 20 | 48 | 76 | 04 | 32 | 160 | 88 | 16 | 44 | 72 | 300 | 28 | 56 | 84 | 8 | 76 | | 16 | 44 | 72 | | 12 | 1940 | 68 | 96 | 24 | 52 | 2080 | | 2120 | 9 |
| 5 | 21 | 49 | 77 | 05 | 33 | 61 | 89 | 17 | 45 | 73 | 01 | 29 | 57 | 8 | 49 | 77 | 1800 | 17 | 45 | 73 | | 13 | 41 | 69 | 97 | 25 | 53 | 81 | | 21 | 5 |
| 6 | 22 | 50 | 78 | 06 | 34 | 62 | 190 | 18 | 46 | 74 | 02 | 330 | 58 | | 750 | 78 | | 18 | 46 | 74 | | 14 | 42 | 1970 | 98 | 26 | 54 | 82 | | 22 | 6 |
| 7 | 23 | 51 | 79 | 07 | 35 | 63 | 91 | 19 | 47 | 75 | 03 | 31 | 59 | | 51 | 79 | | 19 | 47 | 75 | | 15 | 43 | 71 | 99 | 27 | 55 | 83 | | 23 | 7 |
| 14 | 24 | 52 | 80 | 08 | 36 | 64 | 92 | 220 | 48 | 76 | 04 | 32 | 360 | 4 | 52 | 1780 | | 1820 | 48 | 76 | | 16 | 44 | 72 | 2000 | 28 | 56 | 84 | | 24 | 14 |
| 3 | 25 | 53 | 81 | 09 | 37 | 65 | 93 | 21 | 49 | 77 | 05 | 33 | 61 | | 53 | 81 | | 21 | 49 | 77 | 1900 | 17 | 45 | 73 | 01 | 29 | 57 | 85 | | 25 | 3 |
| 4 | 26 | 54 | 82 | 110 | 38 | 66 | 94 | 22 | 250 | 78 | 06 | 34 | 62 | 39 | 54 | 82 | | 22 | 1850 | 78 | | 18 | 46 | 74 | 02 | 2030 | 58 | 86 | | 26 | 4 |
| 5 | 27 | 55 | 83 | 11 | 39 | 67 | 95 | 23 | 51 | 79 | 07 | 35 | 63 | 91 | 5 | 83 | | 23 | 51 | 79 | | 19 | 47 | 75 | 03 | 31 | 59 | 87 | | 27 | 5 |
| 12 | 28 | 56 | 84 | 12 | 140 | 68 | 96 | 24 | 52 | 280 | 08 | 36 | 64 | 92 | 4 | 84 | | 24 | 52 | 1880 | | 1920 | 48 | 76 | 04 | 32 | 2060 | 88 | | 28 | 12 |

FIG. 7

PERPETUAL MECHANICAL CALENDAR

This invention corresponds to the disclosure document No. 264,567 filed Sep. 24, 1990 in the United States Patent and Trademark Office, and the complete disclosure of that disclosure document is hereby incorporated herein by reference.

BACKGROUND OF THE INVENTION

1. Field of the Invention

The invention is in the field of keeping time and, more particularly, relates to a perpetual mechanical calendar capable of displaying the proper calendar for any year.

2. Description of the Related Art

Various calendars have been disclosed which are adjustable to display a 31 day calendar for any month depending upon which day of the week the month begins upon. Such calendars typically have a table which can be consulted to determine what setting to place the calendar in for the appropriate month.

A disadvantage of such types of calendars are that the calendar must display 31 days for every month, regardless of the number of days actually included in that particular month. These typical prior art calendars would, for example, display 31 days for February, regardless of whether February would happen to be a 28 day month, or a leap year 29 day month.

A further disadvantage of such calendars is that they display only one month at a time. To consult a calendar for a month other than the present month, the calendar must be readjusted for each month.

Calendars which display the entire 12 months of a year must be discarded and replaced each year. While such calendars do display the entire year, with the proper number of days in every month, since they are inherently disposable, they cannot be made as aesthetically pleasing in appearance as a calendar of a more permanent nature.

It is thus an object of the present invention to provide a perpetual calendar which operates mechanically to display all twelve months of the year being consulted, for any year from one to infinity.

It is a further object of the invention to provide a calendar which displays the proper calendar for and number of days in each month of the year, regardless of whether the year is a standard year or a leap year.

It is still a further object of the present invention to provide a calendar which, because of its permanent nature, can be styled in a more aesthetically pleasing fashion.

Another object of the invention is to provide a calendar having a front facing surface that can be marked upon and wiped clean for the marking of important dates, birthdays, etc.

SUMMARY OF THE INVENTION

The above stated objects of the invention, as well as other objects of the invention, are attained by a perpetual mechanical calendar disclosed as follows.

The calendar of the present invention comprises a front board, which has twelve windows for displaying the proper calendars for each of the twelve months. A sliding plate is mounted behind this front board, and is printed with two interrelated series of numbers. The first and second series of numbers may preferably be overlapping in rows so that proceeding from top to bottom on the sliding plate, the rows alternate from the first series to the second series and back to the first series and so on to the bottom of the sliding plate. Each series of numbers is arranged so that horizontal movement of the sliding plate will display the calendars for years beginning on each of the seven days of the week. Thus, the two interrelated series of numbers can be used to display the proper calendar for any year from the year one to any year in the future. The first series is for use during years that are regular or non-leap years, and the second series of numbers is for use during years that are leap years.

Means for positioning the sliding plate relative to the front board are also included in the presently disclosed calendar. The means must provide both horizontal and vertical position of the sliding plate. The sliding plate should be movable through these means to an upper position and a lower position in the vertical direction, and seven individual positions in the horizontal direction.

The horizontal positioning means preferably comprises a drive pinion which engages a rack cut into the sliding plate. The rack preferably has teeth on its lower and upper surfaces, which the drive pinion engages when the sliding plate is in its upper or lower positions.

The means for vertically positioning the sliding plate preferably comprise a lever, or a series of levers, which are connected with a holder (or bearing) beam supporting the sliding plate. Rotation of the levers permits raising and lowering of the holder beam and consequently of the sliding plate, changing the series of numbers shown across the windows on the front board. Thus, the levers are used to move the sliding plate between one position where the first series of numbers is displayed, and a second position where the second series of numbers is displayed.

Knobs are affixed to the drive pinion and drive lever to facilitate positioning of the sliding plate.

The windows of the front board of the disclosed calendar may preferably contain seven columns of transparent openings. The remaining area of the windows beyond the transparent openings would preferably be opaque. In this configuration, the first series and second series of numbers could overlap each other in alternating rows so that one series is visible when the sliding plate is in the upper position and the other series of numbers is visible when the sliding plate is in the lower position.

In this configuration, one column of transparent openings may preferably be tinted a non-clear color to designate Sundays and other windows may be tinted in non-clear color to designate other days which are fixed holidays falling on the same date of every year.

BRIEF DESCRIPTION OF THE DRAWINGS

A detailed description of the preferred embodiments of the present invention follows with reference to the accompanying drawings in which:

FIG. 7 is a portion of a table for use in determining the proper reference numeral calendar setting, according to the invention.

DESCRIPTION OF THE PREFERRED EMBODIMENTS

With reference now to the Figures, wherein like numerals depict like elements, detailed descriptions of the preferred embodiments of the invention will be set forth.

Figure 1:
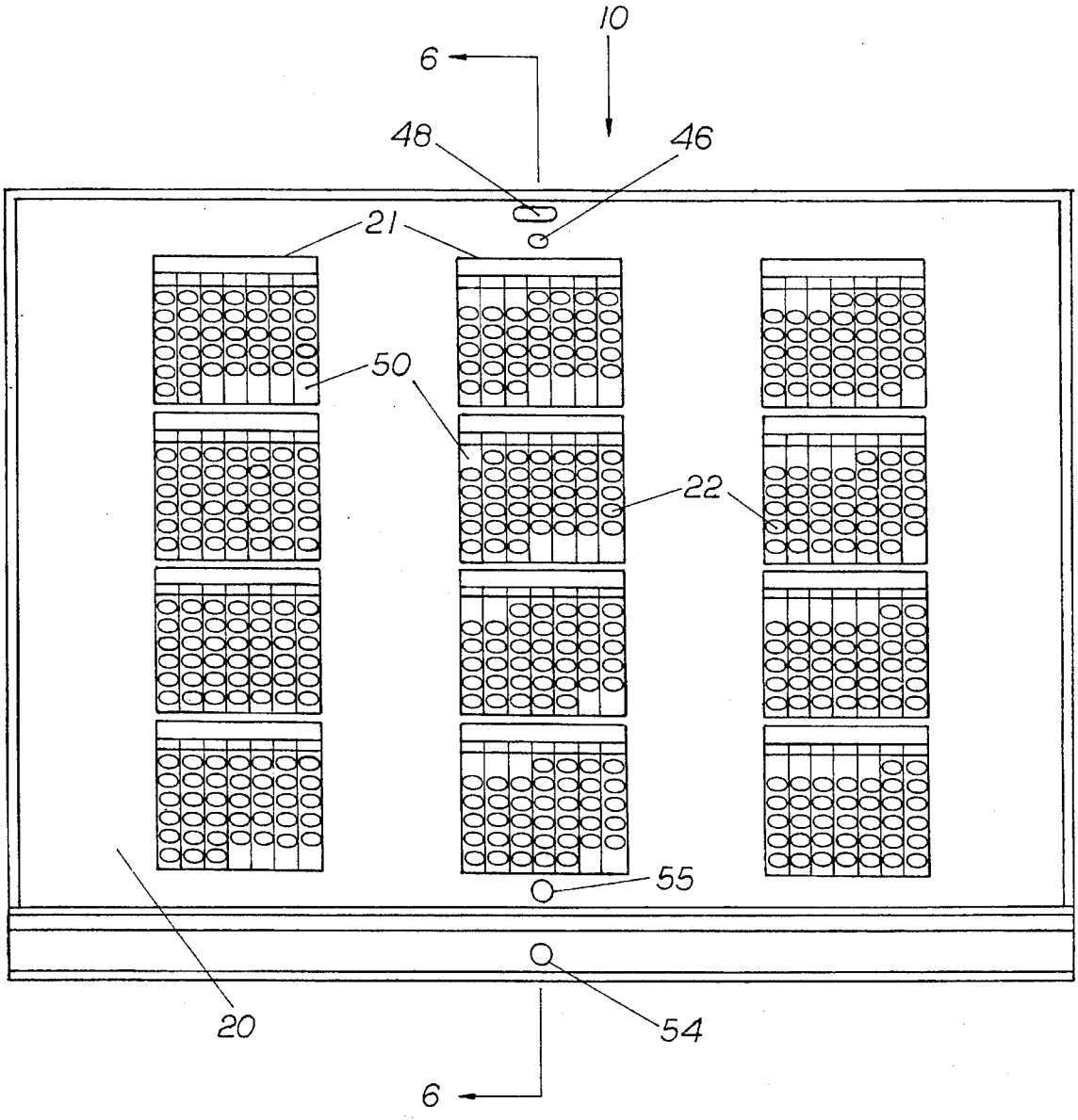
FIG. 1 is a front elevational view of a perpetual mechanical calendar, according to the invention.
Figure 2:
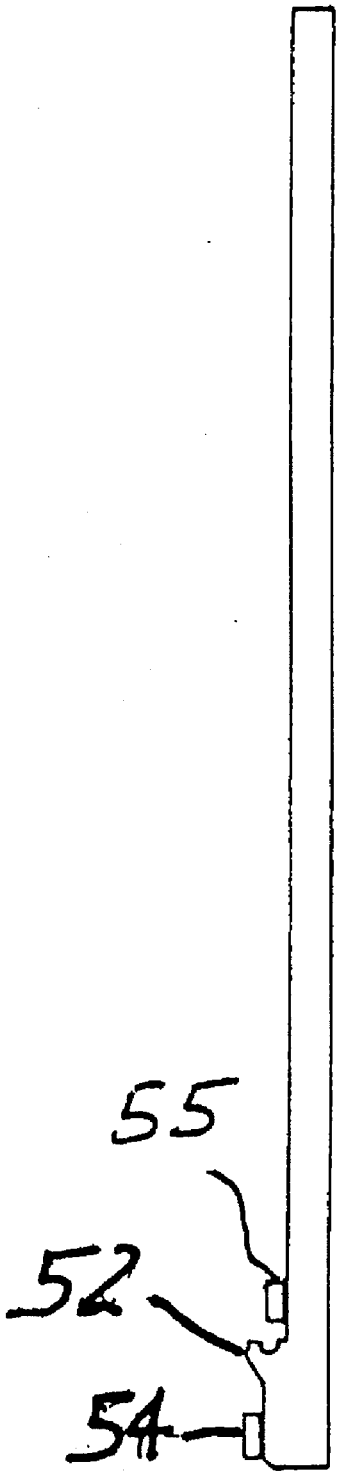
FIG. 2 is a side elevational view of the perpetual mechanical calendar of FIG. 1.
Figure 3:
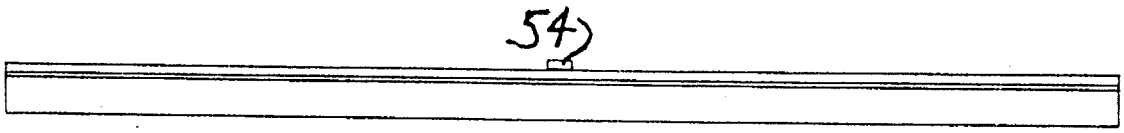
FIG. 3 is a partial front view of the sliding plate, showing the twelve sets of numbers representing dates and two rows of reference numbers printed upon its front face.

With reference to FIG. 1, a perpetual mechanical calendar according to the invention is generally indicated by reference numeral 10. The front board 20 of the calendar 10 has windows 21 through which the calendar for each month of a year can be displayed. The windows 21 preferably have columns of transparent openings 22 through which the actual numbers of the calendar are visible, the remainder of each window being opaque.

Figure 4:
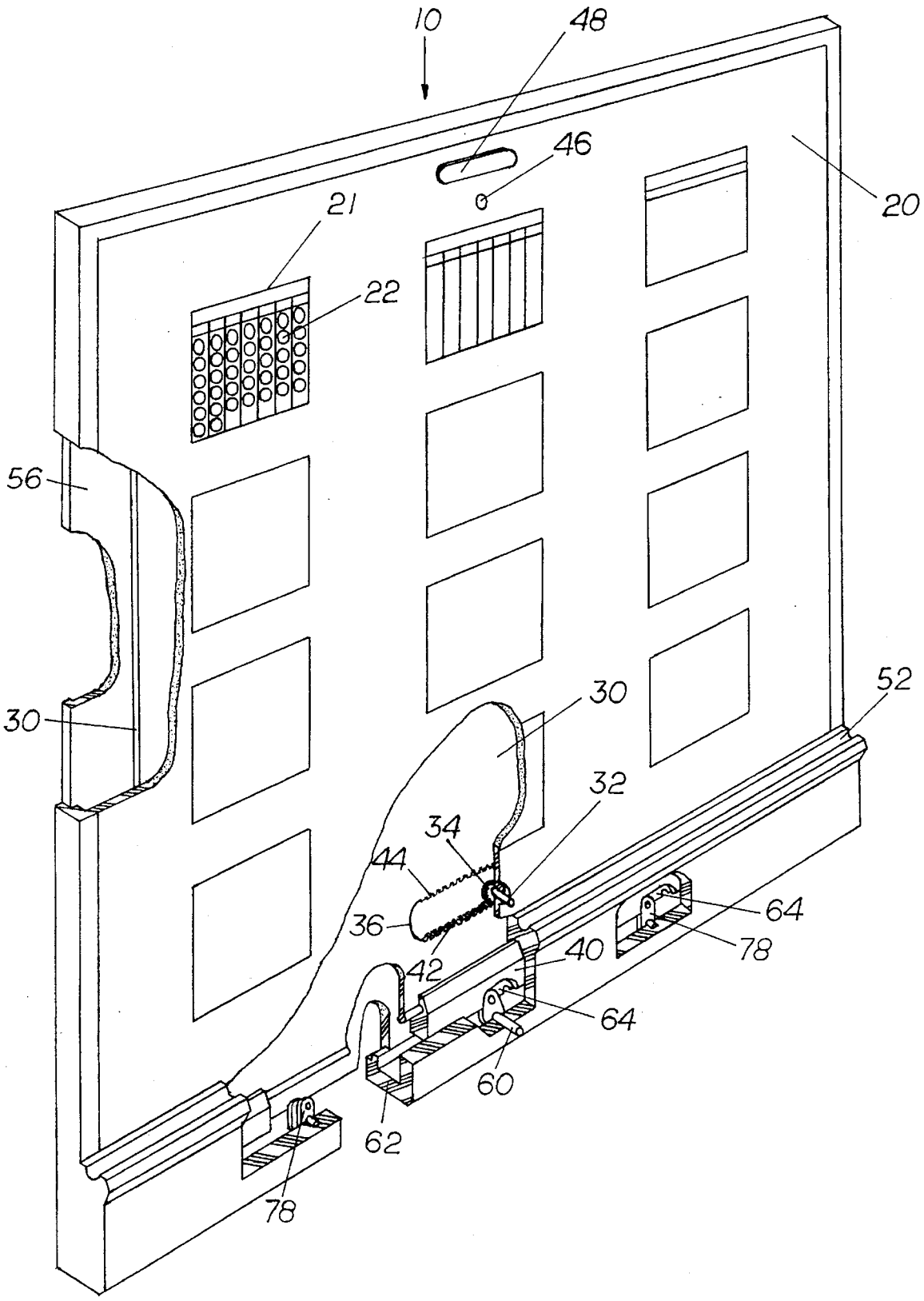
FIG. 4 is a partially cut away perspective view of a perpetual mechanical calendar, according to the invention.

With reference now to FIG. 4, a sliding plate 30 is mounted behind the front board 20 of the calendar 10 so that one of two series of numbers printed on the sliding plate 30 is visible through the transparent openings 22 of the windows 21 of the calendar 10. These numbers are arranged on the sliding plate 30 so that when the sliding plate is moved horizontally and vertically relative to the front board 20, different calendars for an entire year are displayed through the transparent openings 22.

The sliding plate 30 is moved vertically and horizontally by gears and levers as shown in FIG. 4. Horizontal motion of the sliding plate 30 is provided by a knob 55 connected to a shaft 32 which is connected to a gear 34 which engages a rack 36 of the sliding plate 30. The drive shaft 32 can thus be rotated moving the sliding plate horizontally behind the front board 20.

Figures 5, 6:
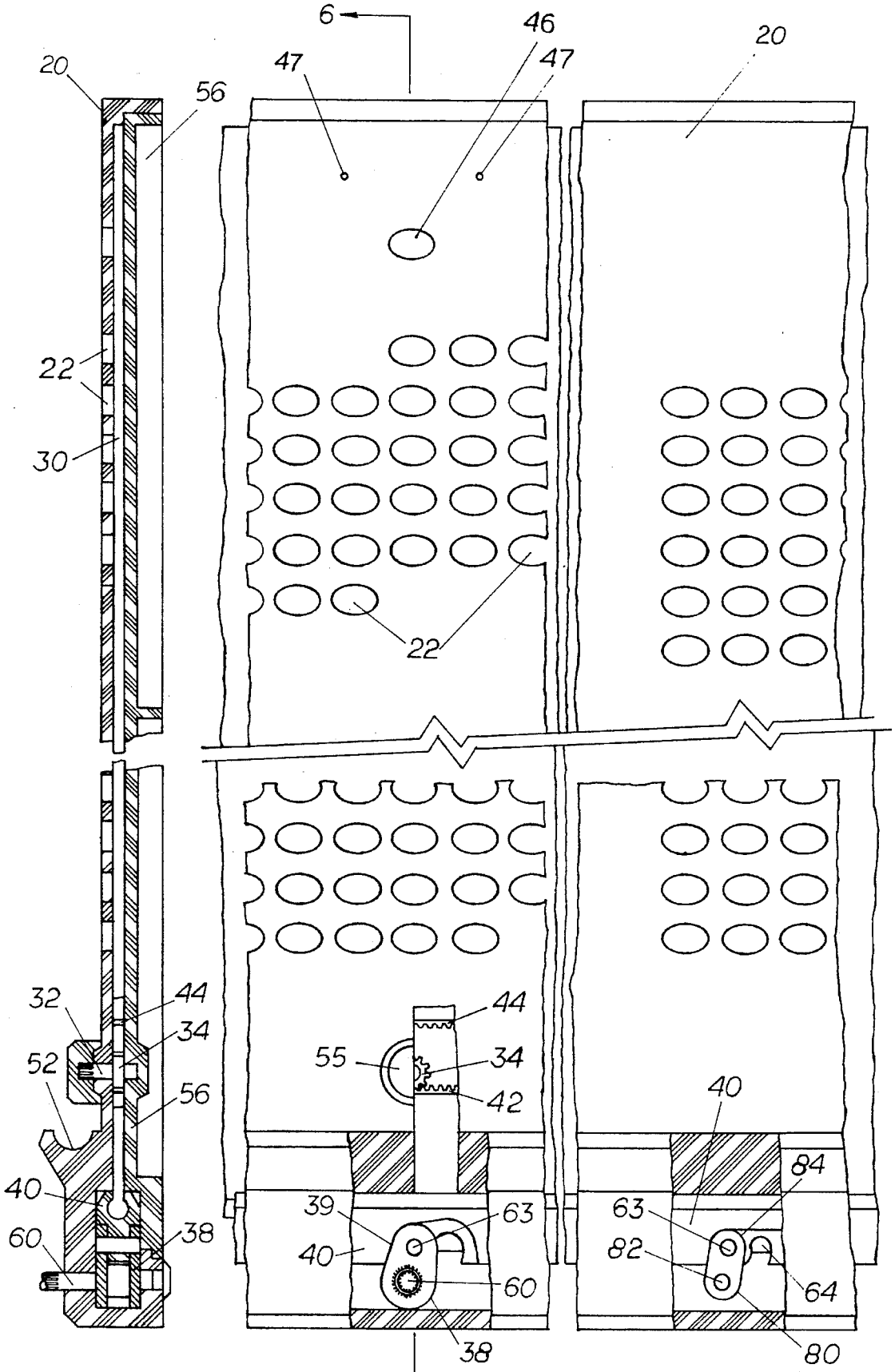
FIG. 5 is a partially cut away front elevational view of a perpetual mechanical calendar, according to the invention.
FIG. 6 is a side cross sectional view of the perpetual mechanical calendar, along the lines 6—6 of FIG. 5.

The sliding plate is moved in the vertical direction by a main drive lever 38, and optionally as shown in FIG. 4, an additional series of drive levers 78 which are affixed to the bottom of the holder beam 40 which carries the sliding plate 30 (FIGS. 5–6). The lower portion 37 of the main lever 38 is affixed and supported within a channel or bottom portion 62 of the front board 20. The opposite or upper end 39 of the main drive lever 38 is secured by pins 63 to the holder beam 40. In like manner, the lower ends 80 of the additional levers 78 are position and affixed within the bottom or channel portion 62 of the front board 20, and the upper or opposite ends 84 of the additional levers 78 are affixed by pins 63 to the holder beam 40. A shaft 60 extends outward from the main drive lever 38 and a knob 54 is placed on its distal end for convenience. In operation, the knob 54 would be rotated in a counter clockwise fashion, thereby rotating the shaft 60 in a counter clockwise direction. As the lower end 37 is held within the bottom portion 62 of the front board 20, the holder beam 40 moves with the main drive lever 38 and to some extent pivots about the pins 63. The shaft 60 is rotated until the holder beam and the sliding plate 30 have been lowered by the required amount. This causes a slight lateral displacement of the holder beam and a notch or recess 64 of the holder beam 40 will then reside over the shaft 60. In a similar fashion, other notches or recesses 64 in the holder beam 40 will move over pins 82 that extend from the levers 78. This operation of the verticle movement is best seen by reference to FIGS. 4, 5, and 6. As best shown in FIG. 6 the sliding plate 30 is positioned within a slot 41 in the holder beam 40. Thus, the upward and downward movement in the holder beam 40 necessarily moves the sliding plate in a similar vertical direction. The sliding plate 30 is positioned within the said slot 41 of the holder beam 40 for horizontal displacement. Any slight horizontal or lateral movement of the holder beam 40 (and necessarily the sliding plate 30) which is caused by verticle movement is more than offset by the means for horizontally positioning the sliding plate.

The main drive lever 38 can be rotated to raise and lower the sliding plate 30 through the holder beam 40 between an upper and a lower position. The sliding plate 30 is shown in FIG. 5 in the upper position. In this upper position, the gear 34 of the drive shaft 32 engages the teeth of the lower surface 42 of the rack 36. The holder beam 40 preferably has recesses 64 which permit the sliding plate 30 to be moved into the lower position. When the main lever 38 is rotated to lower the sliding plate 30 into its lower position, the gear 34 of the drive shaft 32 engages the teeth of the upper surface 44 of the rack 36. The sliding plate 30 is preferably mounted in the holder beam 40 in a slidable fashion so that the sliding plate can be moved horizontally in the holder beam while the holder beam 40 remains horizontally stationary.

In such a fashion, the sliding plate 30 can be moved horizontally between seven different positions and vertically between two different positions. These positions correspond to the numbers printed on the sliding plate 30 which list the proper calendars for years beginning on each day of the week, and also list full calendars for years which are leap years and for years which are not leap years. Thus, the settings are to be used to set the calendar for leap years and non leap years, while the horizontal motion is used to set the calendar for years beginning on the correct day of the week.

The proper calendar to use for any year can be determined from a reference table (FIG. 7) which can be generated using a pattern to assign each year one of fourteen reference numbers. These reference numbers are 1 through 14, each number representing the configuration of a calendar for a particular year. There are fourteen different calendars because there are seven different days on which a year may begin, and the number doubles because there is an entire set to be used for leap years. The reference numerals are to be printed on the sliding plate in two rows, of seven each, one row being the reference numeral for use in years which are not leap years, and the other row being the reference numerals for use in years which are leap years. One of these reference numerals can be displayed through the front board 20 through a reference numeral window 46 (FIG. 1, FIG. 5).

The reference table referred to above is partially set out in FIG. 7. The left most portion of the reference table has a column which contains the 14 reference numbers. The table starts with the year 1, which began on a Sunday. This table is generated with years beginning on a Monday corresponding to Reference numeral 1. Thus, the reference number of the preferred embodiment for a standard year beginning on a Sunday is 7. Because of the number of days in a year, each year following a standard year will begin one day later in the week than the year it follows. Thus, the year two began on a Monday and was also a standard year. Prior to 1582, every fourth year was a leap year. Thus, the sequence of reference numerals down the left hand column of the table jumps to the leap year reference numeral for every fourth year. Since a leap year has an extra day, a year following a leap year will start on the day of the week two days later than the day of the week which the leap year began upon. Thus, in the first column of FIG. 7, referring to year 5, if the year 4 were a standard year, year 5 would have begun on a Thursday which would be reference numeral 4. Because the year 4 was a leap year, year 5 begins two days later and thus begins on a Friday. The first and second series of numbers are arranged so that a leap year starting on a Sunday is a reference numeral 7 digits higher than the standard year starting on a Sunday. Thus, the reference numeral for a leap year beginning on a Sunday is 14. Standard years beginning on Mondays are reference numeral 1, Tuesdays are 2, and so on. Leap years beginning on Mondays are therefore reference numeral 8, and so forth. This pattern of years breaks up evenly into a repeating sequence as printed in the left most column of FIG. 7. Beginning with the year 1582, however, a change was made in the calculation of leap years. A reform initiated by Pope Gregory XIII for the purpose of aligning the seasons with the proper dates of the months changed the way leap years were determined as follows. From 1582 forward, years evenly divisible by 100 (secular years) were deemed to be leap years only if they were also divisible by 400. Thus, from 1582 forwards a pattern of gaps is required to insure the proper sequencing of the years relative to the reference numbers. For every secular year that is non-divisible by 400, five blank spaces are skipped in completing the table in order to insure that the secular year is not a leap year. For these secular years that are not divisible by 400, an additional 11 spaces are skipped after the secular year plus 2.

This pattern of reference numbers for particular years can be determined for any desired year through the application of a series of formulae. These formulae are based on the repetition of the pattern of configurations of the calendar for each year over a period of 28 years. Prior to 1582, this repeating sequence of 28 years is sufficient to determine the proper calendar for any year. Thus, the sequence of calendar configurations starting with the year one and proceeding through the year 28 is a repeating pattern. This pattern is set out in a table below wherein the proper reference number to be used is listed next to the year from one through 28 which it represents. For years prior to 1582, the proper reference number can be determined by dividing the desired year by 28 to determine the remainder of the desired year which is not divisible by 28. This yields a remainder of the range from zero (when the year is evenly divisible by 28) to 27. This remainder can then be cross referenced to the proper reference number of the original 28 year cycle according to the following table.

| Reference No. | Remainder | Reference No. | Remainder |
|---|---|---|---|
| 7 | 1 | 3 | 15 |
| 1 | 2 | 11 | 16 |
| 2 | 3 | 6 | 17 |
| 10 | 4 | 7 | 18 |
| 5 | 5 | 1 | 19 |
| 6 | 6 | 9 | 20 |
| 7 | 7 | 4 | 21 |
| 8 | 8 | 5 | 22 |
| 3 | 9 | 6 | 23 |
| 4 | 10 | 14 | 24 |
| 5 | 11 | 2 | 25 |
| 13 | 12 | 3 | 26 |
| 1 | 13 | 4 | 27 |
| 2 | 14 | 12 | 0 |

For years following 1582, to adjust for the change in handling leap years, the obtained reference number must be modified according to the following equations:

$$R-3-X+Y=M;$$

wherein

R is the originally obtained reference number;

X is obtained by subtracting 1,582 from said desired year to obtrain a sum and dividing this sum by 100, dropping any factions, to obtain a whole number which is used for variable X;

Y is obtained by dividing the above sum by 400, dropping any fraction, to obtain a whole number which is used for variable Y;

M is the resulting modified reference number;

M is then further modified by repeatedly adding 7 to M if M is a negative number until M is a positive number; and M is further modified by repeatedly adding 7 if the original reference number is greater than 7 and the obtained modified reference number is less than 7, until the modified reference number is greater than 7.

It is also possible to program a computer to generate a table similar to that shown in FIG. 7, or to generate reference numbers for desired years according to the above formulae. Thus, the computer could be programmed to determine the proper reference numeral for any entered year from the year 1 to infinity. The computer program would be based on the pattern of the above formulae wherein every fourth year is a leap year equivalent of the standard year beginning on that day, a year following a leap year begins two days after the year on which the leap year began, and secular years after 1582 which are not divisible by 400 are not leap years. After obtaining the proper reference number from the computer, the calendar is then set to the determined reference number to display the proper calendar.

Once the proper year is located on the calendar, the calendar may be held in that position by a locking plate 48 which has pegs (not shown in any drawings) extending from the back thereof. One peg of the locking plate 48 is of sufficient length that it passes through the front board 20 and into one of a series of holes located in the sliding plate 30 to hold the sliding plate 30 fast. The locking plate 48 may best be made so that the proper year can be displayed thereupon.

One column of the transparent openings 22 of the windows 21 of the front board 20 can preferably be made of a tinted color. This column is designated as reference number 50 in FIG. 1. This column 50 of tinted transparent openings 22 are suitably used to denote which day of the week is Sunday. Further, the series of numbers on the sliding plate 30 itself can be marked to denote holidays which fall on the exact same date every year such as, for example, Independence Day or Christmas.

The front board 20 of the calendar is preferably coated or laminated with any suitable substance so that the front board 20 can be written upon and yet wiped clean. This is to allow the marking of special dates, birthdays, etc. on the calendar which markings can be erased when the calendar is reset to a new year.

For this purpose, the calendar can preferably be equipped with a holder 52 (FIG. 6) which can be used to hold marking pencils, chalk, etc. for marking on the calendar.

The drive shaft 32 and main drive lever 38 are preferably mounted to knobs 54, 55 which can be used for proper and easy adjustment of the calendar.

A back board 56 (FIG. 6) is preferably mounted to the calendar behind the sliding plate 30, to give the calendar rigidity and retain the sliding plate 30 in the proper position.

Thus disclosed is a perpetual mechanical calendar which can display the proper 12 month calendar for any year from the year one to infinity, which is easily adjustable for leap years, which displays the proper number of days in every month, which can be marked upon for the convenience of the user, and which is usable for an infinite duration of time, so that the calendar can be made with an aesthetically pleasing appearance.

While the preferred embodiments of the disclosed invention are set forth above, it must be appreciated that various modifications and changes can be made to the disclosed invention without departing from the spirit or scope of the appended claims.

I claim:

1. A perpetual mechanical calendar comprising:

a front board having twelve windows;

a sliding plate mounted behind said front board and having a front face, said front face having a first series of numbers and a second series of numbers printed thereon so that a portion of one of said series of numbers for each month of the year is visible through said windows;

means for vertically positioning said sliding plate relative to said front board between one of seven positions, wherein said horizontal positioning means comprises a drive pinion having a gear engaging a rack cut into said sliding plate so that said pinion can be rotated to move said sliding plate horizontally relative to said front board; and, means for vertically positioning said sliding plate relative to said front board between an upper position and a lower position.

2. A calendar according to claim 1 wherein said vertical positioning means comprises at least one drive lever in contact with said sliding plate and movable between a first position wherein said first series of numbers is visible through said windows of said front board, and a second position wherein said second series of numbers is visible through said windows of said front board.

3. A calendar according to claim 2, wherein said rack has an upper surface and a lower surface so that when said lever is in said first position, said lower surface of said rack engages said pinion, and when said lever is in said second position, said upper surface of said rack engages said pinion.

4. A calendar according to claim 1, wherein said first series of numbers corresponds to months contained in leap years, and said second series of numbers corresponds to months contained in non-leap years.

5. A calendar according to claim 1, wherein each of said windows of said front board contains seven columns of transparent openings, and said first series and said second series of numbers overlap each other in alternating rows so that when said sliding plate is in said upper position, said openings display a portion of said first series of numbers, and when said sliding plate is in said lower position, said openings display a portion of said second series of numbers.

6. A calendar according to claim 1, further comprising means for determining a proper position for said sliding plate for any year.

7. A calendar according to claim 1, wherein said means for determining a proper position for said sliding plate for any year comprises a reference number window in said front board and 14 reference numbers printed on said sliding plate so that one reference number is visible through said reference number window in each position of said sliding plate, and a selected reference number corresponding to a desired year can be located in said reference number window to display a calendar for said desired year.

* * * * *